US010909956B2

(12) United States Patent
Patitucci et al.

(10) Patent No.: US 10,909,956 B2
(45) Date of Patent: Feb. 2, 2021

(54) APPARATUS AND METHOD FOR PRODUCING AND STREAMING MUSIC GENERATED FROM PLANTS

(71) Applicants: Joseph William Patitucci, Marina Del Rey, CA (US); Jonathan Shapiro, Marina Del Rey, CA (US)

(72) Inventors: Joseph William Patitucci, Marina Del Rey, CA (US); Jonathan Shapiro, Marina Del Rey, CA (US)

( * ) Notice: Subject to any disclaimer, the term of this patent is extended or adjusted under 35 U.S.C. 154(b) by 0 days.

(21) Appl. No.: 16/822,005

(22) Filed: Mar. 18, 2020

(65) Prior Publication Data

US 2020/0380939 A1 Dec. 3, 2020

Related U.S. Application Data

(63) Continuation-in-part of application No. 16/424,419, filed on May 28, 2019, now Pat. No. 10,636,400.

(51) Int. Cl.
*G10H 1/00* (2006.01)
*G10H 1/053* (2006.01)

(52) U.S. Cl.
CPC ..... *G10H 1/0025* (2013.01); *G10H 1/0066* (2013.01); *G10H 1/053* (2013.01); *G10H 2210/111* (2013.01)

(58) Field of Classification Search
CPC ..... G10H 1/0025; G10H 1/0066; G10H 1/14; G10H 2220/101; G10H 2210/325; G10H 2220/371; G10H 2210/391; G10H 1/053; G10H 2220/111; A61B 5/7264; A61B 5/6801; A61B 5/02438
See application file for complete search history.

(56) References Cited

U.S. PATENT DOCUMENTS 4,919,143 A * 4/1990 Ayers ..... A61B 5/0482 128/905
5,253,168 A * 10/1993 Berg ..... A61B 5/4857 128/905
5,267,942 A * 12/1993 Saperston ..... A61M 21/02 128/905
5,321,350 A * 6/1994 Haas ..... G01R 23/02 324/76.11
5,343,871 A * 9/1994 Bittman ..... A61B 5/0482 128/905
5,692,517 A * 12/1997 Junker ..... A61B 5/0482 600/545
6,487,817 B2 * 12/2002 Airaudi ..... A61B 5/05 47/1.3
6,743,164 B2 * 6/2004 Airaudi ..... A01G 7/00 47/1.3
6,893,407 B1 * 5/2005 Brooks ..... G06F 3/016 600/300
7,207,935 B1 * 4/2007 Lipo ..... A61B 5/16 600/28

(Continued)

*Primary Examiner* — Jeffrey Donels
(74) *Attorney, Agent, or Firm* — Keeley DeAngelo LLP; W Scott Keeley

(57) ABSTRACT

A method for producing and streaming music generated from plants. Plant microfluctuations are converted to MIDI notes and subsequent CC messages, and are mapped to a unique signal chain of virtual instruments and effects to produce musical notes which are output through the speakers of an apparatus, or through a linked portable electronic device.

3 Claims, 4 Drawing Sheets

(56) References Cited

U.S. PATENT DOCUMENTS

| | | | | |
|---|---|---|---|---|
| 7,915,514 | B1 * | 3/2011 | Shrem | G10H 1/0075 84/615 |
| 2002/0026746 | A1 * | 3/2002 | Airaudi | A63J 17/00 47/17 |
| 2006/0084551 | A1 * | 4/2006 | Volpe, Jr. | G06F 19/3481 482/8 |
| 2006/0102171 | A1 * | 5/2006 | Gavish | A61B 5/486 128/95.1 |
| 2006/0111621 | A1 * | 5/2006 | Coppi | A61B 5/486 600/300 |
| 2010/0236383 | A1 * | 9/2010 | Vogel | G10H 1/0025 84/600 |
| 2011/0021318 | A1 * | 1/2011 | Lumsden | A63B 69/00 482/8 |
| 2012/0316453 | A1 * | 12/2012 | Marcarian | G09B 19/003 600/546 |
| 2014/0302471 | A1 * | 10/2014 | Hanners | G09B 19/003 434/247 |
| 2019/0333487 | A1 * | 10/2019 | Patitucci | G10H 1/0066 |

* cited by examiner

300

APPARATUS AND METHOD FOR PRODUCING AND STREAMING MUSIC GENERATED FROM PLANTS

This application is a continuation-in-part application of U.S. patent application Ser. No. 16/424,419 filed 2019 May 28.

TECHNICAL FIELD

The present disclosure relates to an apparatus and method for producing and streaming music generated from microfluctuations in conductivity on the surfaces of plants.

BACKGROUND

Methods and devices that detect biological variations in plants are known in the art. Sensors that detect conductivity in plants are used in ecological, plant-propagation and other plant-biology applications.

With the availability of a Musical Instrument Digital Interface (MIDI) platform in the 1980s, methods and computer devices have been developed to translate microfluctuations in conductivity in plants into MIDI notes that are then played by synthesizers to produce music."

A MIDI sound generator is a hardware-based or software-based synthesizer.

MIDI information includes MIDI note and continuous-controller (MIDI CC) messages. A MIDI processor processes MIDI through a master clock, MIDI bus and MIDI effects.

MIDI effects include MIDI signal processors, which include MIDI scalers, MIDI pitch effects, MIDI chord processors, arpeggiators, note-length effects and other effects.

MIDI scalers limit MIDI note data streams to a specific scale or key.

MIDI pitch effects determine the base pitch of a note and can be used to change the octave of a specific instrument or to change the interval relationship between one MIDI note stream and another.

Arpeggiators define the number of MIDI notes that can be expressed per measure.

An audio master mixes the output of various MIDI instruments.

MIDI instruments are sample-based instruments, oscillators or tone generators.

Audio effects include audio signal processors such as delay, reverb, distortion, overdrive, bit-crushing, filters, resonators, gain, equalizers, panning, vibrato, tremolo, compressor, and other effects.

Continuous-control (CC) messages are a category of MIDI messages which are used to convey performance or patch data for parameters other than those which have their own dedicated message types (e.g., note on, note off, aftertouch, polyphonic aftertouch, pitch bend, and program change).

Signal-chain processing refers to a flow of control from one input to another. Output from one portion of the chain supplies input to the next. In this context signal-chain processing refers to the intentional alteration of audio signals.

Note-shifting is the use of MIDI software to shift musical notes.

Presets are specific configurations of MIDI Instruments, MIDI effects and audio effects.

Portable electronic devices include smartphones, tablet devices, home computers and the like.

Algorithms are processes or sets of rules to be followed in calculations or other problem-solving operations, especially by a computer.

A logarithm is a quantity representing the power to which a fixed number must be raised to a given number. In this embodiment, logarithmic functions are applied to values generated from a plant, resulting in specific ranges of control messages which, together with MIDI note messages, are translated into musical tones by the embodiment's software.

Sonification refers to the generating of musical tones from data.

A "computer readable-medium" is also known as software.

A 555 timer is an integrated circuit used in timer, pulse-generation, and oscillator applications. The 555 is commonly used in LED and lamp flashers, pulse-generation, tone generation, and security alarms. An astable 555 timer puts out a continuous stream of rectangular pulses of a specific frequency.

SUMMARY

The disclosed apparatus and method produces and streams music generated from plants. Plant microfluctuations are converted to MIDI notes and subsequent CC messages, and are mapped to a unique signal chain of virtual instruments and effects to produce musical tones that can be customized by the end-user.

A MIDI plant device is referred to here as an apparatus and method that:

- Receives and measures microfluctuations in the conductivity of plants. The method employs a set of machine-readable language instructions (hereafter referred to as software) that receives these signals.
- Graphs these fluctuations as waves or data patterns.
- Sends this MIDI information to a user's device, where software uses stored musical instruments to process the MIDI notes into sound and change the textual qualities of those sounds, and outputs them, in the form of musical tones, to the speakers of an electronic device.

Open-source firmware dictates that notes are created only when a change in electrical conductivity is sensed in the plant. An astable 555 timer generates a 1-kHz wave into the plant. Resulting microfluctuations (aka pulses) in plant conductivity are measured.

The plant device's firmware employs an interrupt routine to cause a microcontroller to measure these pulses, which identifies changes in timing. The plant device's firmware detects fluctuations occurring in the plant, and then translates these fluctuations into MIDI notes. The notes produced are proportional to the difference in conductivity between a baseline and the measured change event. The baseline is determined by analysis of a sample set of microfluctuations. Every 10 milliseconds a sample set of microfluctuations is collected and held in an array of ten samples per group for analysis. Once ten samples are collected, an average and a standard deviation are determined. A delta is defined between the minimum and maximum samples. If the delta is greater than the product of (standard deviation×threshold), a change is detected. Once a change is detected, a note is created. The duration of that note is the delta, mapped between 250-2500 milliseconds. When conductivity goes up, notes go up on a scale, and when conductivity goes down, notes go down on a scale.

In addition to creating MIDI note values from the waves of plant microfluctuations, a derivative of the plant waves is used to create MIDI control values. As this output is controlled by a derivative, the control messages correspond to larger shifts in a plant's electric activity, adding dimension to the ongoing microfluctuations that drive the creation of notes as described above. These control messages are expressed as CC values. Periods of change within the duration of MIDI notes cause CC values to go up or down.

The embodiment's hardware sends the MIDI notes and control values over Bluetooth, Wifi or a wired connection to a mobile device or computer which runs the embodiment's software.

The software of the embodiment controls which instruments are played, as well as the texture of those instruments as controlled by effects. The software analyzes output from the MIDI plant device, applying specific algorithms, a MIDI processor, MIDI instruments and audio effects to produce varying musical tones, which are amplified through the speakers of a personal electronic device.

The plant microfluctuations, as processed by the MIDI treatment above, determines specific ranges of continuous-control messages (CCs) and octave controls.

During software analysis a master clock determines tempo in beats per minute. A MIDI bus takes the MIDI note and continuous-controller (CC) messages from the algorithm and busses them to multiple MIDI channels.

Within each MIDI channel, MIDI notes are run through a series of MIDI effects. The MIDI notes are then sent to MIDI instruments. Instruments and effects are affected by the MIDI control values that are derived as explained above. As this output is controlled by a derivative, the control messages correspond to larger shifts in a plant's electric activity. The resulting audio data including notes, instruments and effects, is sent to an audio master.

An audio master uses an audio mixer to mix the output of the various MIDI instruments and includes volume and panning controls. Master audio effects are applied to the mix of MIDI instruments, producing a master output, which is sent to the portable electronic device as musical tones.

The above steps are described in more detail in an example embodiment. In such an embodiment the system and apparatus converts data from a MIDI plant device into music. To create musical tones from the plant's microfluctuations, the system and apparatus performs the following steps:

1. Applies an algorithm to translate a plant's conductivity microfluctuations to MIDI note and MIDI CC values
2. Runs the MIDI note and MIDI CC values through a MIDI processor
3. Resulting MIDI notes and MIDI CC values control MIDI instruments
4. MIDI instruments are run through audio effects. Audio effects are modulated by CC messages.
5. MIDI instruments and audio effects are sent through a virtual mixer, resulting in an audio output.
6. The audio is sent via Bluetooth/Wifi to software on the portable electronic device. Audio is output through a speaker of a portable electronic device. Audio is also visually represented by the embodiment's graphical user interface on a portable electronic device.

To generate MIDI notes (Step 1, above), the method reads a plant's conductivity microfluctuations as numbers. These numbers are used to create MIDI note values to control pitch.

The numbers are then sent via wired connection, Bluetooth, or WiFi into a MIDI processor in the embodiment's software to be played by virtual instruments with timbre and rhythmic components controlled by MIDI CC values.

In Step 2 (above), MIDI CC values are determined by an algorithm that analyzes relationships between the created MIDI notes, and assigns those relationships a numerical value between 0-127.

MIDI note and MIDI CC values are sent to the MIDI processor to control pitch, timing and timbre qualities of digital instruments. In the MIDI processor, MIDI notes are run through an array of MIDI effects, some of which are modulated by the MIDI CC data. The output of the MIDI Processor is MIDI note and MIDI CC data.

The MIDI processor consists of:

- A clock, which determines the tempo of all time-based MIDI effects;
- MIDI scalers, which scale all MIDI notes to a specific key (e.g., A-pentatonic).
- Arpeggiators, which control the timing at which note messages are sent from the MIDI processor to digital instruments;
- Note wrapping, which defines the lowest note and octave range of MIDI notes;
- MIDI transposition effects, which shift a MIDI note from its input value to a new output value. For instance, a MIDI note message can come in at a value of 60, which is C4 or middle C, and be pitched+12 to a value of 72, or C5 (one octave above middle C).

MIDI CC data can control parameters of components of the MIDI processor and can control whether those components are active. For instance, MIDI CC data can be mapped to control the clock/tempo within a certain range, or it can be used to control arpeggiators within a certain range; and it could be used to turn on and off components of the MIDI processor.

MIDI note and MIDI CC messages output from the MIDI processor are sent to control MIDI Instruments.

In Step 3, MIDI instruments are controlled by MIDI note and MIDI CC messages. The output of MIDI instruments is audio.

MIDI Instruments can be built in three ways:

- Through sound synthesis;
- As sample-based instruments where a sample of a single root note is pitched/shifted to create other notes;
- A combination of sample-based instrumentation and synthesis.

MIDI CC values are used to modify the sounds of the MIDI instruments by using ranges of CC data to:

- Change parameters on a synthesizer (for instance, attack, decay, sustain and release);
- Turn on/off MIDI instruments;
- To toggle between instruments.

In Step 4, audio from the output of MIDI instruments is run through the method's audio effects before it is output as musical tones. Examples of audio effects include gain, reverb, delay, distortion, bit-crushing, filtering, equalizing and resonating.

MIDI CC data is used to change parameters and/or activation of audio effects. For instance, thresholds of MIDI CC data can be used to:

- Change the depth or wetness of a reverb, or change the rate, feedback or depth of a delay;
- Turn on and off effects modules;
- Toggle between effects modules.

In an example embodiment, plant-data sonification software is hosted on the method's server. This software employs a sound engine comprised of MIDI instruments.

A user accesses that plant-data sonification software through a web page or a smartphone app. The plant-sonification software recognizes the user and pairs (connects) with that user, allowing their particular plant data to stream to the user's portable electronic device.

The method's software converts received plant data into MIDI information through an algorithm in the plant-data sonification software. This MIDI information controls MIDI instruments in the plant-data sonification software. A user can listen to the sounds generated through the MIDI instruments through their portable electronic device or through any paired audio device.

The software further allows users to upload their MIDI to an Internet cloud server, where it may be streamed by others. Other users can access the plant-data sonification software on the method's server through the the method's web page or smartphone app. They can stream the MIDI information from the server to their portable electronic devices so that it can control the MIDI instruments on the plant-data sonification software that they have installed on their portable electronic device.

The user pairs their MIDI plant device with the plant-data sonification app on their portable electronic device, and the device firmware sends the MIDI information to the plant-data sonification app, where it is processed into sound. Through an algorithm in the plant-data sonification app, this MIDI information controls MIDI instruments that produce musical tones. Listening through their portable electronic device/phone or paired audio device, the user hears musical tones generated through the MIDI instruments.

The user may then choose to stream MIDI information to the method's server for other app users to stream.

Any of these embodiments are understood to be non-exclusive and interchangeable.

DESCRIPTION

Figure 1:
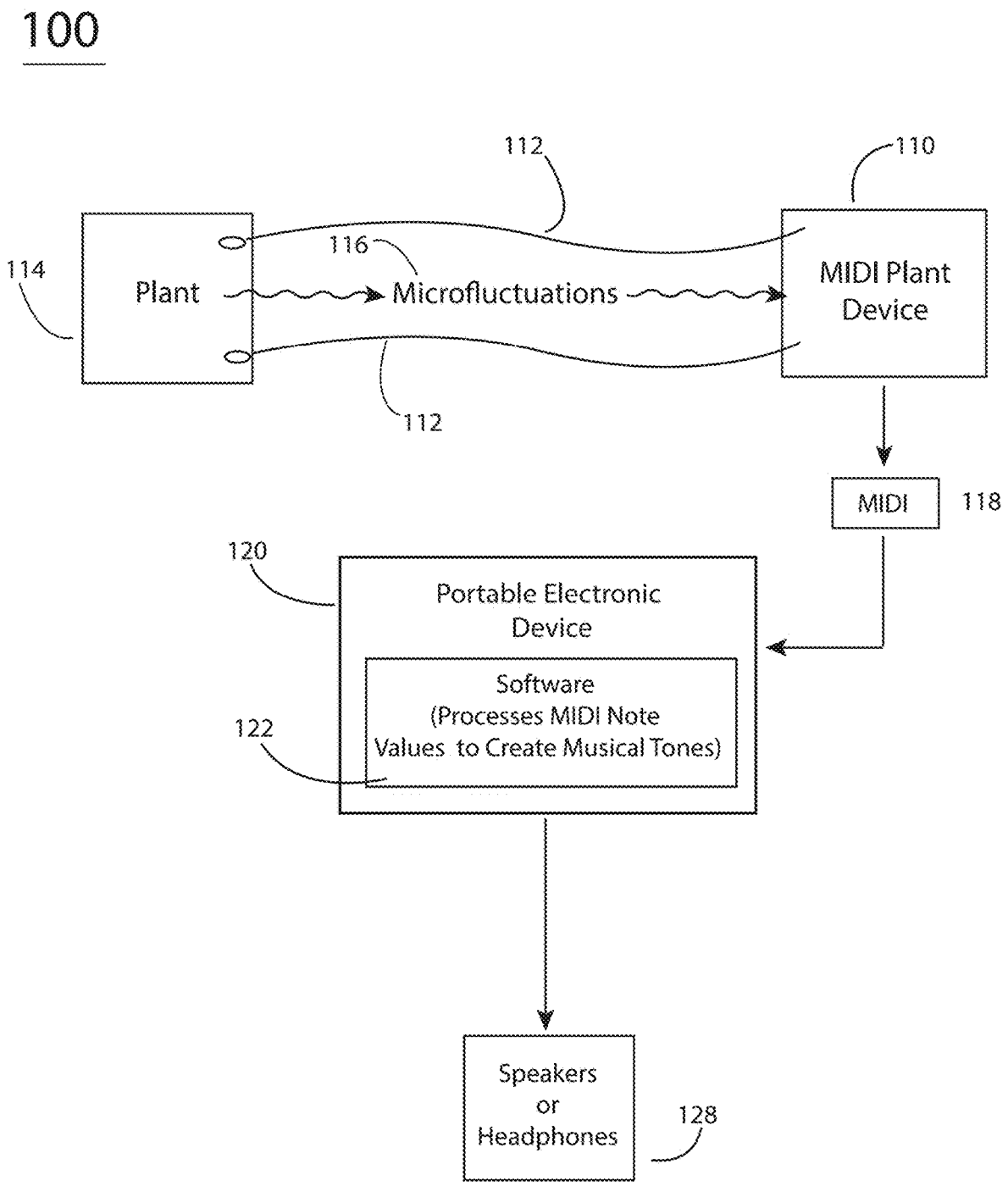
FIG. 1 is an illustration of an example embodiment.

In FIG. 1, example embodiment 100: MIDI plant device 110 sends 3.3 volts of electric current via electrodes 112 to the leaves of a plant 114. Microfluctuations 116 from the plant are sent through the same electrodes to the MIDI plant device 110. MIDI plant device 110 graphs these fluctuations as waves or data patterns and translates these data patterns into MIDI note and control messages 118.

Open-source firmware in the MIDI plant device 110 dictates the creation of notes when variations in electrical conductivity are sensed in the plant. Each note produced is proportional to the difference in conductivity between a baseline and a measured change event. When conductivity goes up, notes go up in a scale, and when conductivity goes down, notes go down in a scale. In addition to generating MIDI note values from the waves of plant microfluctuations, derivatives of plant waves are applied to create MIDI control values. Because this output is controlled by a derivative, the generated control values correspond to larger shifts in a plant's electric activity, adding dimension to the ongoing microfluctuations that drive the creation of notes as described above.

That information is received by a portable electronic device 120 via wired connection, Bluetooth or Wifi. Ongoing microfluctuations continue to drive the creation of notes; software 122 on the device continually analyzes MIDI information, and the process as described above loops to continually produce musical tones.

The software 122 controls what virtual instruments are played, as well as the texture of those instruments as controlled by effects. Resulting musical tones are delivered through the device's speakers or headphones 128.

Figure 2:
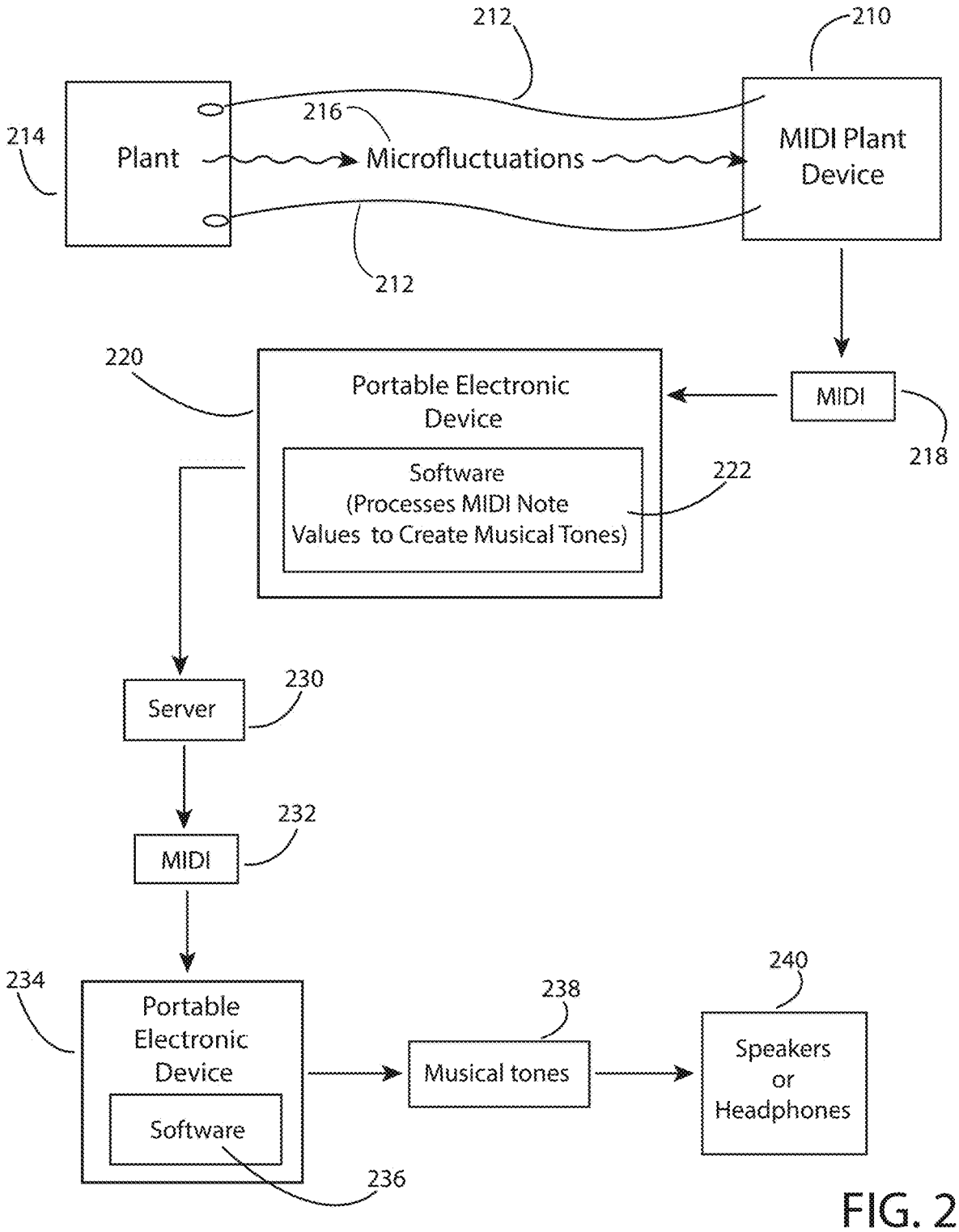
FIG. 2 illustrates a second embodiment.

Referring to FIG. 2, in example embodiment 200, MIDI plant device 210 sends 3.3 volts of electric current via electrodes 212 to the leaves of a plant 214. Microfluctuations 216 from the plant are sent through the same electrodes to the MIDI plant device 210. MIDI plant device 210 graphs these fluctuations as waves or data patterns and translates these data patterns into MIDI control messages 218. Open-source firmware in the MIDI plant device dictates the creation of notes when variations in electrical conductivity are sensed in the plant. Each note produced is proportional to the difference in conductivity between a baseline and a measured change event. When conductivity goes up, notes go up in a scale, and when conductivity goes down, notes go down in a scale.

In addition to generating MIDI note values from the waves of plant microfluctuations, derivatives of plant waves are applied to create MIDI control values. Because this output is controlled by a derivative, the generated control values correspond to larger shifts in a plant's electric activity, adding dimension to the ongoing microfluctuations that drive the creation of notes as described above.

That information 232 is received by a portable electronic device 220. Software 222 on the device analyzes the MIDI information and employs a specific algorithm to apply MIDI processing, virtual instruments, and audio effects. Ongoing microfluctuations continue to drive the creation of notes; software 122 on the device continually analyzes MIDI information, and the process as described above loops to continually produce musical tones 124.

The software 222 controls which virtual instruments are played, as well as the texture of those instruments as controlled by effects.

Resulting MIDI note values may be sent via Internet connection to the embodiment's server 230. Users connect to the server to send their MIDI information or to stream other users' MIDI information. The embodiment's software, which users have loaded onto their devices, connects, through an Internet connection, to the server 230, enabling the user to stream MIDI information 232 to or from the server.

In receiving MIDI from the server, software 236 on this user's device 234 analyzes the MIDI information and employs a specific algorithm to apply virtual instruments and audio effects to produce musical tones 238. As ongoing microfluctuations drive the ongoing creation of tones, the software 236 controls what virtual instruments are played, as well as the texture of those instruments as controlled by effects.

Resulting musical tones 238 are delivered through the device's speakers or headphones 240.

Figure 3:
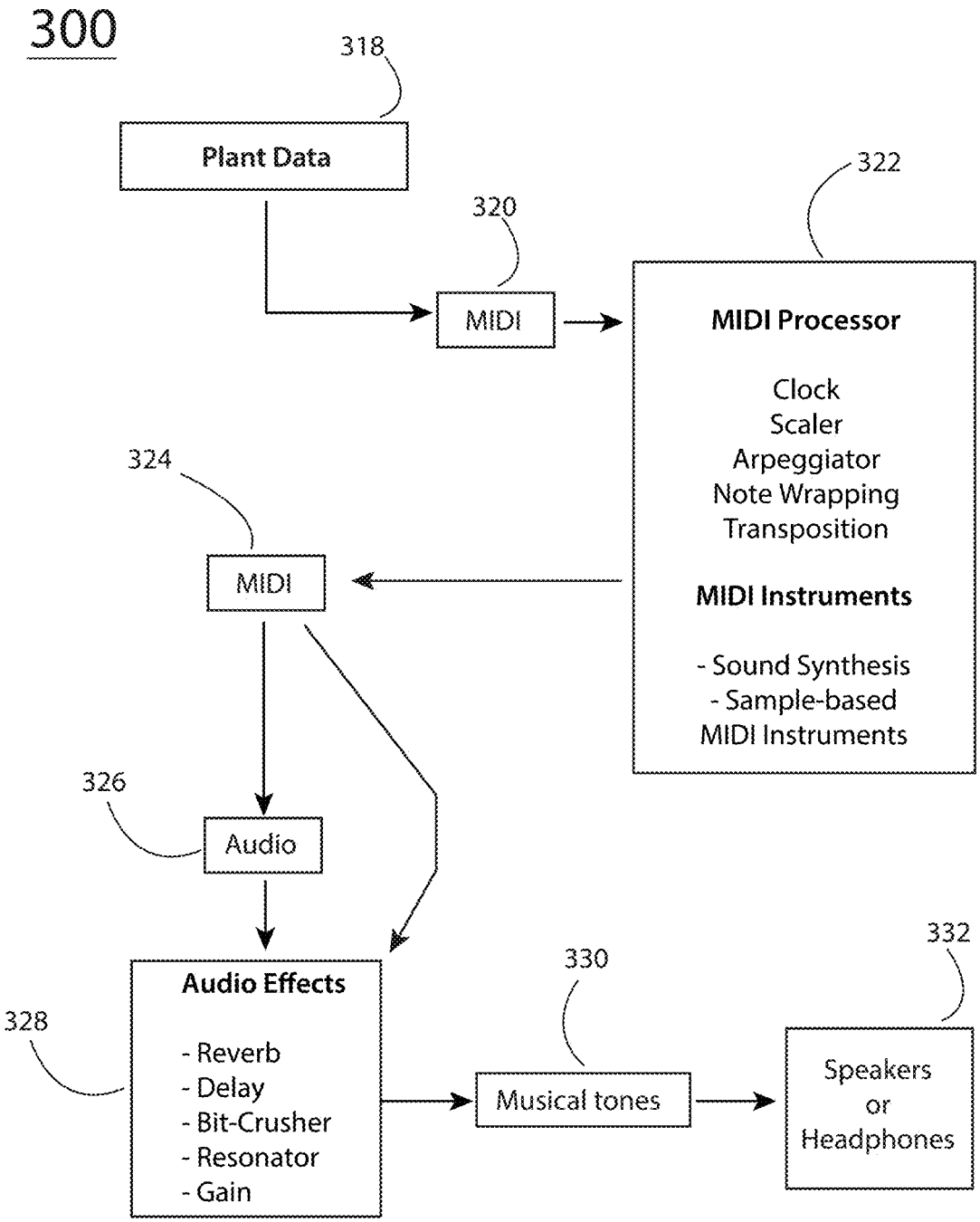
FIG. 3 illustrates in detail the signal-processing functions of FIGS. 1 and 2.

FIG. 3, 300 illustrates in detail the software method's MIDI and sound-engine processes. A MIDI processor 322 applies the functions of clock, scaler, arpeggiator, note-wrapping and transposition to MIDI 320 derived from plant data 318. A master clock determines tempo in beats per minute or in samples per second. A MIDI bus takes the MIDI note and continuous-controller (CC) messages from the algorithm and busses them to multiple MIDI channels. MIDI instruments process the MIDI thus generated 324 from the data into audio 326. Audio effects 328, which include reverb, delay, bit-crushing, filters, resonators, gain, equalizers, are added and modulated by the CCs derived from the plant data. The resulting output is sent in the form of in musical tones 330 to a device or speaker 332.

Figure 4:
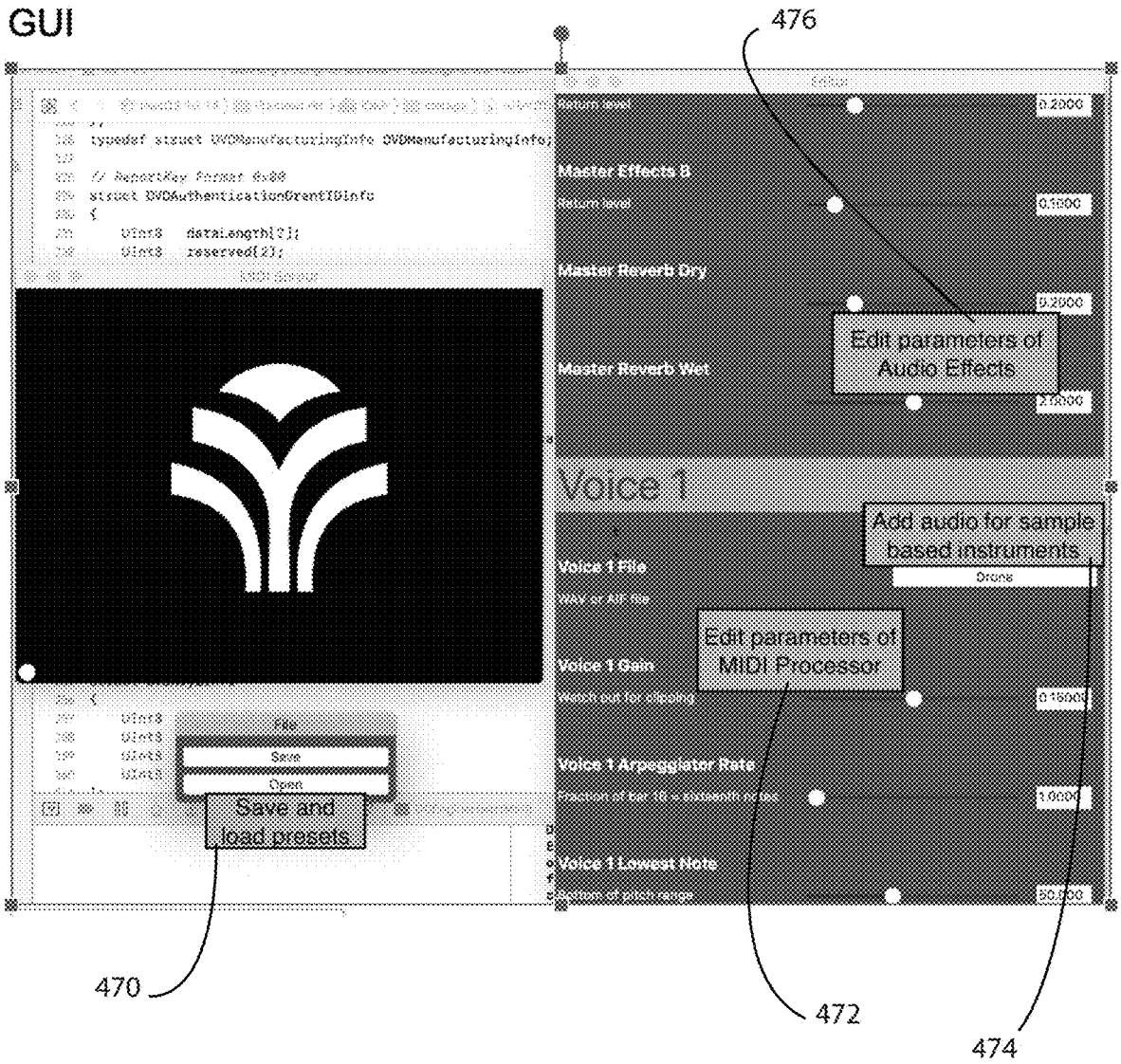
FIG. 4 shows an example graphical user interface of an example embodiment.

FIG. 4, 300 shows an example graphical user interface (GUI) of the embodiment. The GUI is for the user to adjust and customize the sound. The GUI provides buttons for saving and loading preset audio configurations 470 and allows the user to edit parameters of audio effects 476; edit parameters of MIDI processor 472; or add audio for sample-based instruments 474.

The invention claimed is:

1. A method and apparatus for generating music from microfluctuations in a plant comprising:

a MIDI plant device for measuring plant microfluctuations; and said measured plant microfluctuations converted into MIDI note messages; and said measured plant microfluctuations converted into continuous control messages; and said MIDI notes and continuous control messages sent to a portable electronic device; and software in said portable electronic device processes MIDI notes by applying;

timing; and scale; and transposition; and arpeggiation; and said software uses virtual instruments to output musical tones; and said software uses synthesized musical effects based on said continuous control messages with said synthesized instruments to apply musical effects to said musical tones; wherein measured plant microfluctuations are converted into musical tones in a scale played on virtual instruments, with musical effects.

2. The apparatus of claim 1 further comprising:

said plant device for measuring changes in plant microfluctuations and converting them into MIDI note and control messages over time; and said software processes the MIDI notes into sound and assigns musical effects to said tones that are modulated by said control messages; wherein plant microfluctuation changes over time to determine the output of musical effects.

3. A method for generating music from measured plant microfluctuations, employing the apparatus of claim 1, the method comprising:

measuring plant microfluctuations; and converting said measured plant microfluctuations to MIDI notes; and converting said measured plant microfluctuations to continuous control messages; and processing MIDI notes into sounds through virtual instruments; and assigning musical effects to said sounds that are modulated by continuous control messages;

wherein music is created by software musical instruments playing MIDI notes and musical effects as derived from plant microfluctuations.

* * * * *